United States Patent [19]

Bothe

[11] 3,948,077

[45] Apr. 6, 1976

[54] FORGING PRESS WITH INDEPENDENT HAMMER-POSITION ADJUSTMENT AND OVERLOAD PROTECTOR

[75] Inventor: Werner Bothe, Dusseldorf, Germany

[73] Assignee: Maschinenfabrik Hasenclever GmbH, Dusseldorf, Germany

[22] Filed: Mar. 5, 1975

[21] Appl. No.: 555,429

[30] Foreign Application Priority Data

Mar. 9, 1974 Germany ..... 2411340

[52] U.S. Cl. ..... 72/432; 72/441; 72/450; 100/53

[51] Int. Cl.[2] ..... B21J 13/00

[58] Field of Search ..... 72/431, 432, 446, 450, 72/449

[56] References Cited

UNITED STATES PATENTS

| | | | |
|---|---|---|---|
| 2,232,889 | 2/1941 | Spencer | 72/450 |
| 2,522,452 | 9/1950 | Johansen | 72/432 |
| 2,979,975 | 4/1961 | Schloz | 72/446 |
| 3,041,899 | 7/1962 | Benninghoff | 72/432 |
| 3,521,475 | 7/1970 | Bothe | 72/450 |

FOREIGN PATENTS OR APPLICATIONS

| | | | |
|---|---|---|---|
| 934,019 | 8/1963 | United Kingdom | 72/450 |

*Primary Examiner*—C. W. Lanham
*Assistant Examiner*—Gene P. Crosby
*Attorney, Agent, or Firm*—Karl F. Ross; Herbert Dubno

[57] ABSTRACT

The forging press has a horizontal drive shaft on which is carried an eccentric body linked to a vertical force-transmitting block whose lower surface lies at an angle to the horizontal and flushly engages the top of a horizontally reciprocal wedge whose bottom surface lies on the hammer. Interfitting ridges and grooves interconnect the wedge, the force-transmission block, and the hammer so that the hammer hangs from the wedge and the wedge from the force-transmission block. A spindle threaded into the wedge is rotatable to establish its horizontal position, and, therefore, to set the relative position of the force-transmission block in the hammer. At its other end this spindle is provided with a piston reciprocal in a horizontally extending hydraulic chamber which is maintained under a predetermined pressure. The threshold at which the wedge may slip to the side and protect the hammer from overloading is established by the pressure in this hydraulic cylinder.

10 Claims, 2 Drawing Figures

FORGING PRESS WITH INDEPENDENT HAMMER-POSITION ADJUSTMENT AND OVERLOAD PROTECTOR

FIELD OF THE INVENTION

My present invention relates to a forging press. More particularly this invention concerns a forging press having an overload protector and a hammer-position adjustment.

BACKGROUND OF THE INVENTION

A forging press is known having a press frame which carries a pressing table adapted to receive the workpiece and which has a generally horizontal driveshaft carrying an eccentric driver that is in force-transmitting engagement with a vertically reciprocal hammer. The stroke of the hammer is established by the eccentricity of the eccentric driver.

It is known to adjust the lower limit of the piston stroke by means of a relatively complicated arrangement that displaces the rotation axis of the shaft carrying the eccentric driver. Thus the driveshaft is itself journaled eccentrically in a pair of sleeves or bushings which can be rotated by means of gearing.

This system has been combined with an overload protector whereby when the upward force exerted on the driveshaft by the hammer exceeds a predetermined force on eccentric bushing mounting this driveshaft may rotate, thereby preventing the press from damaging itself or the workpiece through overload. This system has the considerable difficulty that such an overload protector puts the apparatus out of adjustment. In addition it is very difficult to arrange the system such that the overload protector will only be effective at a predetermined force, as the angular positions of the adjustment-bushing axis and driveshaft axis determines the amount of upward force transferred as angular force to the eccentric bushings.

Another known system allows adjustment of the forging press by raising and lowering the working table. This is effected by means of wedges displaceable under the table. Such an arrangement is disadvantageous in that the position of these wedges underneath the work table exposes them to the injurious effects of workpiece chips and oil that tend to drain off the table.

OBJECTS OF THE INVENTION

It is therefore an object of the present invention to provide an improved forging press.

Yet another object is the provision of such a press wherein the lower limit of the hammer stroke can readily be adjusted.

Yet another object is to provide such an improved forging press wherein the force at which the overload protector cuts in can be accurately determined and set.

A further object is to provide a press wherein operation of the overload protector in no way changes the hammer adjustment.

SUMMARY OF THE INVENTION

These objects are attained according to the present invention in a press wherein the generally horizontal driveshaft is journaled on the frame and is rotatable about an axis fixed relative to the frame. A slide including a pressing element or hammer is upwardly connected to an eccentric driver on the shaft by means of a force-transmission block which is vertically slidable on the frame and has a seat receiving the driver and a wedge having a pair of relatively inclined camming surfaces one of which is in force-transmitting engagement with the block and the other of which is in force-transmitting engagement with the pressing element or hammer. According to this invention a cylinder is provided on the slide and houses a piston with one face turned towards the wedge. A spindle extends between this face of the piston and wedge and has a threaded region which is screwed into the wedge. Thus rotation of this spindle will set the relative positions of the force-transmitting block and the pressing element or hammer. In addition means is provided for pressurizing the cylinder to its side opposite the face from which the spindle extends so as to urge the piston toward the wedge. In this manner when the component of horizontal force exerted by the piston against the wedge exceeds this predetermined pressure the wedge will be able to slide so as to allow the force-transmission block and pressing element to shift relative to one another. Therefore this piston and cylinder arrangement constitute the overload protector.

This means for maintaining a predetermined pressure in the cylinder may be a pump and hydraulic circuit that allows for the automatic repressurizing of this chamber after actuation of the overload protector. It is also possible in accordance with this invention to provide a so-called burst cup that merely seals off the cylinder.

In accordance with yet another feature of this invention, guide ridges and grooves parallel to the surfaces of the wedge are provided on both the wedge, the pressing element or hammer, and the force-transmission block. These ridges and grooves serve to link these three elements vertically together so that the hammer effectively hangs from the wedge which itself hangs from the force-transmission block. The driver on the shaft according to this invention comprises an eccentric cylindrical body integrally formed with the shaft, and a driver element formed in part of a cylindrical sleeve surrounding this body and itself constrained from rotating. This driver element is formed with a downwardly projecting lobe that is received in a seat on the force-transmission block. The entire slider is hung from this driver element. This arrangement does not require the adjustment wedge to be tightly clamped in place so that adjustment is relatively simple.

With the system according to the present invention the operation of the overload protector and the adjustment of the hammer are fully independent. Thus if the device is temporarily overloaded it can be reset, either by repressurizing the cylinder or replacing the burst membrane, without the necessity of readjusting the position of the hammer. Furthermore it is possible either to change this adjustment or change the operational threshold of the overload protector independently of one another.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figure 1:
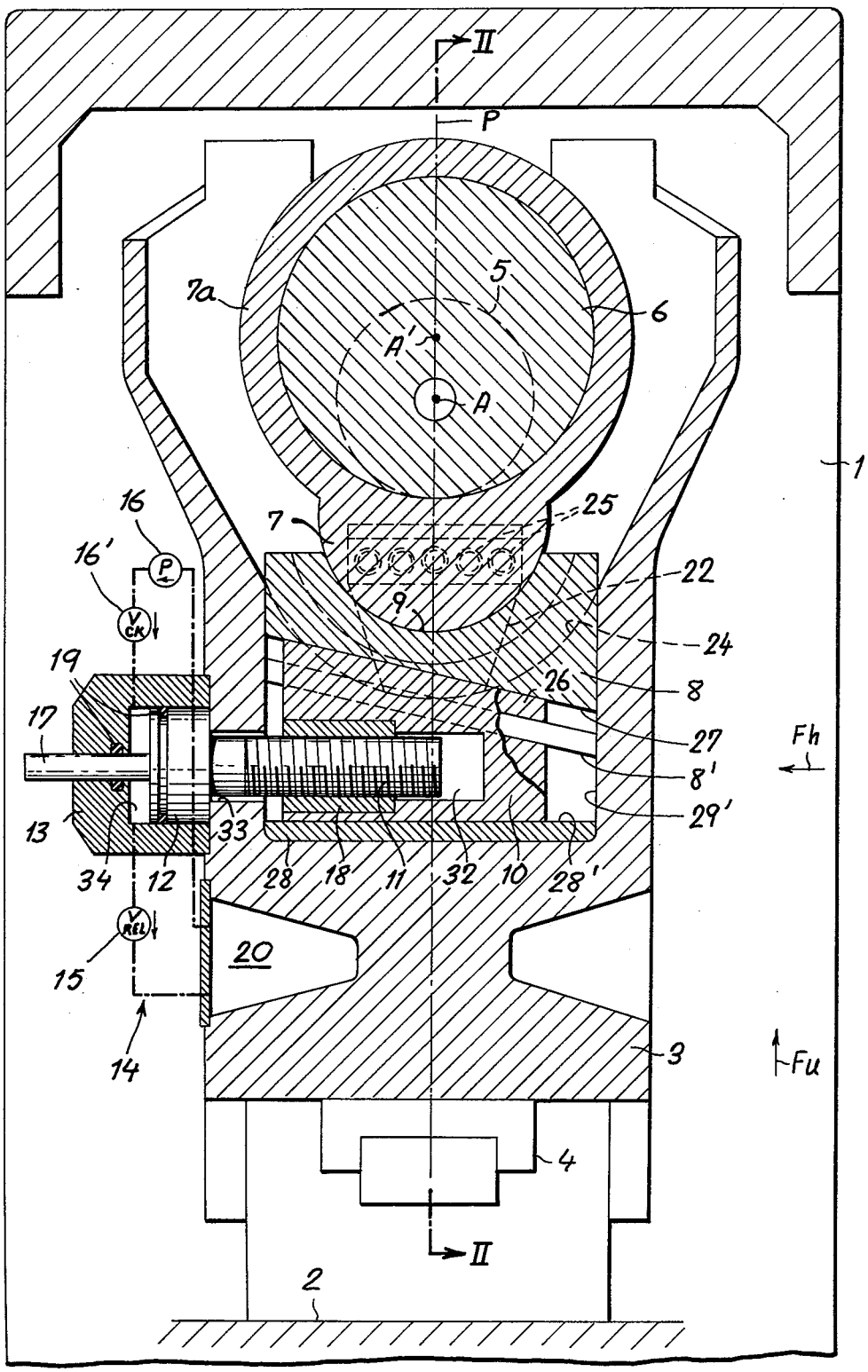
FIG. 1 is a vertical cross-section through a forging press in accordance with this invention.
Figure 2:
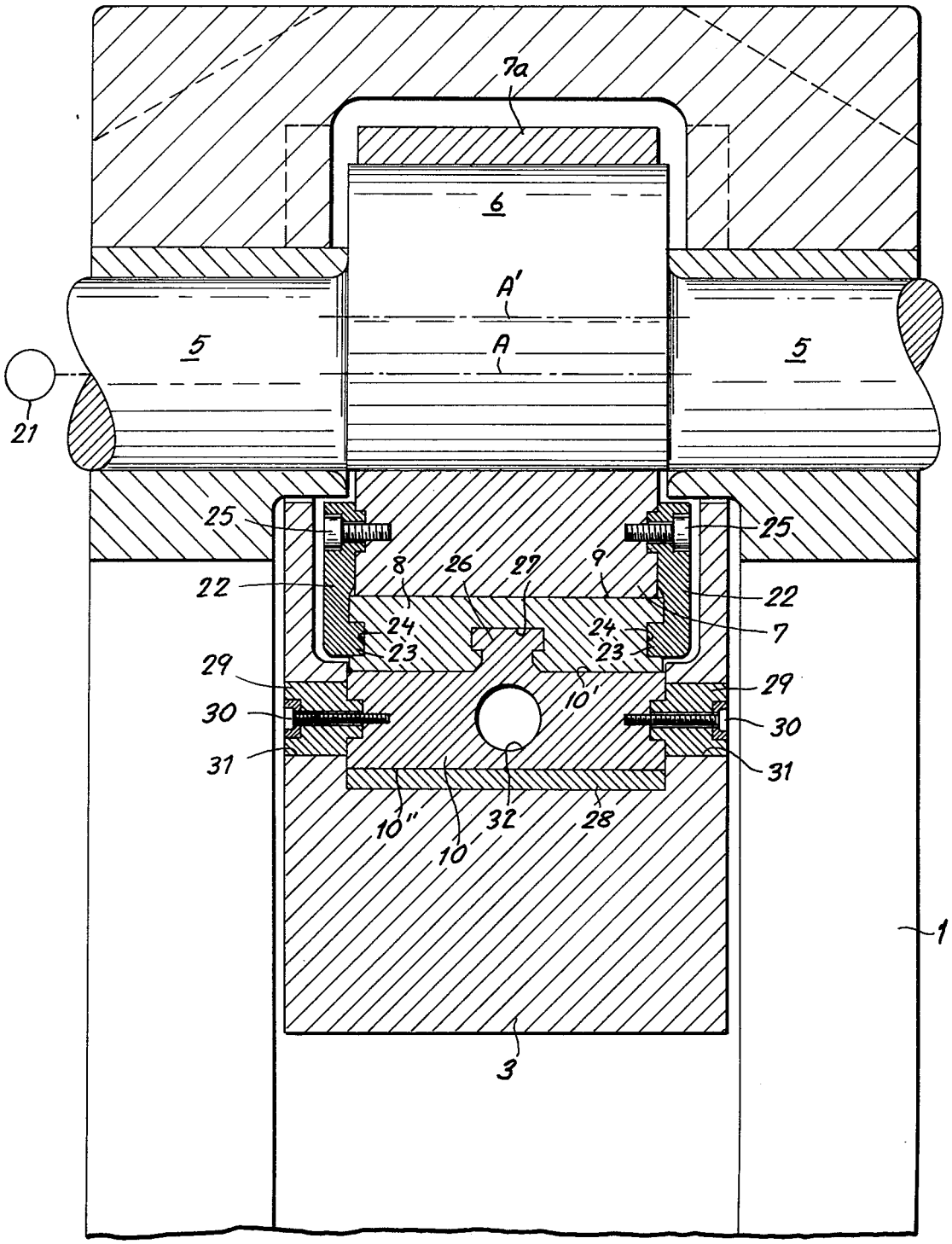
FIG. 2 is a section taken along line II—II of FIG. 1.

As shown in FIG. 1 a forging press has a press frame 1 in which is journaled a horizontal drive shaft 5 defining and rotatable about a horizontal axis A and fixed relative to the frame 1. A motor 21 serves to rotate this shaft 5 and carries an eccentric driving body 6 of cylindrical shape and having an axis A′ offset from the axis A and parallel thereto.

A sleeve 7*a* of generally cylindrical shape snugly surrounds the body 6 and carries a lobular driver element 7 of generally semicylindrical shape and received in a seat 9 of similar part-cylindrical shape of a force-transmission block 8.

A pair of cheek elements 22 have inwardly extending ends 23 received in corresponding grooves 24 formed in the side of the block 8 so that this block 8 is effectively hung from the driver 7. The grooves 24 have the same center of curvature as the lobular driver 7 so that twisting of the entire driver 7 can separate these two elements if desired, although normally the lobular driver 7 will hang down below the sleeve 7*a*. Allen screws 25 secure the cheeks 22 to the driver 7.

An adjustment wedge 10 has an upper surface 10′ formed with an upwardly projecting T-section rib 26 fitting in a correspondingly T-shaped groove 27 in the lower surface 8′ of the force-transmission block 8. Both of the surfaces 10′ and 8′ are inclined at an angle of between 10° and 15°, here 12°, to a vertical plane P including the axis A.

The wedge 10 has a lower surface 10″ perpendicular to the plane P and riding on an upper surface 28′ as a planar bearing member 28 fitted in the upper side of a concavity 29′ in a hammer 3. This concavity 29′ snugly receives and allows vertical reciprocation of the force-transmitting member and is wider perpendicular to the plane P than the wedge 10 so that this wedge 10 may reciprocate perpendicular to this vertical plane P. Secured to both sides of the wedge 10 are rails or guide stips 29 secured in place by means of Allen screws 30 and slidable in horizontal cutouts or grooves 31 formed in the sides of the hammer 3. Thus the wedge 10 hangs via the rib 26 and groove 27 from the force-transmission block 8 whereas the hammer 3 hangs by these ridge-forming elements 29 from the wedge 10.

At its lower end the hammer 3 is provided with a forging tool 4 vertically reciprocal in the plane P relative to a workpiece table 2 adapted to receive a workpiece.

The wedge 10 is formed with horizontal stepped bore 32 fitted with a threaded bushing 18 in which is threadedly received a horizontal spindle 11 having an unthreaded portion extending out through the side of the hammer through a hole 33. A hydraulic cylinder member 13 secured to the element 3 has a chamber 34 in which is horizontally reciprocal a piston 12 from one face of which extends the spindle 11 and from the other face of which extends an adjustment rod 17. Seals 19 are provided on both the piston 12 and the rod 17 to prevent hydraulic leakage. A hydraulic network 14 comprising a reservoir 20 formed in the hammer 3, a pump 16 and check valve 16′ in series, and a pressure-relief valve 15 between the chamber 34 and the reservoir 20 serve to maintain the pressure in the chamber 34 above a predetermined limit established by the pressure-relief valve 15.

The forging press functions as follows:

During normal operation the rotating shaft 5 causes the driver 7 to reciprocate vertically, thereby vertically reciprocating the hammer 3. The vertical velocity of the hammer 3 increases and decreases sinusoidally.

Should the upward force Fu exerted against the hammer exceed a predetermined limit so that the horizontal component Fh of this force exerted against the wedge is sufficient to overcome the hydraulic pressure in the chamber 34 the wedge 10 will shift to the left, as seen in FIG. 3. This allows the hammer 3 to shift relative to the force-transmission block 8 to prevent damage to the hammer or to the workpiece. Once the workpiece is removed from between the tool 4 and the table 2 or the condition causing this overload force is otherwise corrected the pump 16 operates so as automatically to repressurize the chamber 34, thereby returning the hammer 3 to the position it occupied relative to the block 8 before the overload.

Should it be desired to change the relative position of the hammer 3 relative to the block 8 the operator need merely rotate the shaft 17 so as to turn the piston 12 and spindle 11, thereby screwing the wedge 10 in a horizontal direction. This operation is best done when the pressure in the chamber 34 is relieved.

With the system according to the present invention the entire arrangement of block 8, wedge 10, and spindle 11 can be packed in grease so as to increase its service life considerably over that of the prior-art forging presses. In addition due to the completely independent operation both of the adjustment, by means of rotation of the stem 17, and of the overload threshold, by means of adjustment of the valve 15, setting up of the forging press according to the present invention is an extremely simple operation.

I claim:

1. A press comprising:

a press frame;

a pressing table fixed on said frame;

a generally horizontal drive shaft on said frame having a rotation axis fixed relative to said frame;

a driver on said shaft eccentric to said axle;

a slide vertically slidable on said frame and including a force-transmission block having a seat receiving said driver, whereby rotation of said shaft vertically reciprocates said block;

a wedge having relatively inclined upper and lower surfaces and displaceable horizontally, said upper surface bearing against said block, and said slide bearing against said lower surface of said wedge, whereby the position of said wedge establishes the relative positions of said block and slide;

a cylinder on said slide;

a piston in said cylinder having one face turned horizontally toward said wedge and an opposite face turned away from said wedge;

a spindle on said piston extending from said one face and having a threaded region threadedly received in said wedge, whereby rotation of said spindle displaces said wedge horizontally in said slide; and means for pressurizing said cylinder to the side of said opposite face for urging said piston toward said wedge with a predetermined force.

2. The press defined in claim 1 wherein said wedge is provided with a threaded bushing, said spindle being threadadedly engaged in said bushing.

3. The press defined in claim 1 wherein said piston is provided with an adjustment stem extending from said cylinder outside said slide.

4. The press defined in claim 1 wherein said wedge and said block are formed with a first set of interfitting and sliding grooves and ridges parallel to said upper surface and said wedge and said slide are formed with a second set of interfitting and sliding grooves and ridges parallel to said lower surface, said means for pressurizing including a fluid reservoir, a pump connected between said reservoir and said cylinder, and a pressure-relief valve connected between said cylinder and said reservoir, said piston being provided at its opposite face with an adjustment stem extending from said slide and rotationally coupled to said spindle.

5. The press defined in claim 1 wherein one of said surfaces is inclined to a vertical plane passing through said rotation axis and the other of said surfaces is perpendicular to said plane.

6. The press defined in claim 5 wherein said upper surface is said one surface.

7. The press defined in claim 1 wherein said wedge, and said block are formed with a first set of interfitting and sliding grooves and ridges extending parallel to said upper surface, said wedge and said slide being formed with a second set of interfitting and sliding grooves and ridges extending parallel to said lower surface, whereby said wedge hangs by said first set from said block and said slide hangs by said second set from said wedge.

8. The press defined in claim 7 wherein said block is formed with a T-slot parallel to said upper surface and constituting said ridges of said first set.

9. The press defined in claim 1 wherein said means for pressurizing includes a hydraulic network including a source of hydraulic fluid and a pump for drawing fluid from said source and introducing said fluid into said cylinder.

10. The press defined in claim 9 wherein said network includes an adjustable pressure-relief valve between said cylinder and said reservoir.

* * * * *